US007981003B1

(12) United States Patent
Jacobson

(10) Patent No.: US 7,981,003 B1
(45) Date of Patent: Jul. 19, 2011

(54) REAR BRACE ARTICULATING STILT

(76) Inventor: Zachary T. Jacobson, Menomonie, WI (US)

( * ) Notice: Subject to any disclaimer, the term of this patent is extended or adjusted under 35 U.S.C. 154(b) by 410 days.

(21) Appl. No.: 12/135,046

(22) Filed: Jun. 6, 2008

Related U.S. Application Data

(60) Provisional application No. 60/933,575, filed on Jun. 7, 2007.

(51) Int. Cl.
*A63B 21/00* (2006.01)

(52) U.S. Cl. ..... 482/25; 482/26; 623/28

(58) Field of Classification Search ..... 482/25–26; 623/28, 32, 27; 135/65
See application file for complete search history.

(56) References Cited

U.S. PATENT DOCUMENTS

| | | | |
|---|---|---|---|
| 31,210 | A | 1/1861 | Johnson |
| 642,841 | A | 2/1900 | Freshour |
| 2,620,345 | A | 12/1952 | Dean |
| 2,827,897 | A | 3/1958 | Pawlowski |
| 3,902,199 | A | 9/1975 | Emmert |
| 4,255,822 | A | 3/1981 | Dixon |
| 4,415,063 | A | 11/1983 | Hutchison |
| 4,570,926 | A | 2/1986 | Ensmenger |
| 5,016,869 | A | 5/1991 | Dick et al. |
| 5,295,932 | A | 3/1994 | Rowan |
| D359,313 | S | 6/1995 | Hashman |
| 5,498,220 | A | 3/1996 | Ensmenger |
| 5,514,054 | A | 5/1996 | Rowan |
| 5,593,373 | A | 1/1997 | Hale |
| 6,517,586 | B2 | 2/2003 | Lin |
| 6,648,803 | B1 | 11/2003 | Jay |
| 6,719,671 | B1 | 4/2004 | Bock |
| 6,840,893 | B2 | 1/2005 | Yoon |
| 2002/0077704 | A1 | 6/2002 | Lin |
| 2002/0177906 | A1 | 11/2002 | Phillips |
| 2003/0203793 | A1 | 10/2003 | Emmert |
| 2004/0176221 | A1 | 9/2004 | Waxler |
| 2005/0202940 | A1 | 9/2005 | Simmons |
| 2005/0277522 | A1 | 12/2005 | Wong |
| 2006/0211545 | A1 | 9/2006 | Smyer |
| 2006/0217241 | A1 | 9/2006 | Novara |
| 2007/0027004 | A1 | 2/2007 | Novara |
| 2007/0042874 | A1 | 2/2007 | Arginsky et al. |
| 2007/0042875 | A1 | 2/2007 | Arginsky et al. |
| 2007/0072746 | A1 | 3/2007 | Fukui |
| 2007/0167296 | A1 | 7/2007 | Hika |

(Continued)

FOREIGN PATENT DOCUMENTS

| | | | |
|---|---|---|---|
| FR | 2620345 | A1 | 9/1987 |

*Primary Examiner* — Jerome W Donnelly
(74) *Attorney, Agent, or Firm* — Albert W. Watkins

(57) ABSTRACT

The present invention combines an articulated stilt with a rear-mounted leg support or brace behind the leg of the user. The articulating stilt has a foot operative to contact a surface to be traversed, a boot rest operative to support a human foot thereon extending in a longitudinal direction between a heel region and toe region and thereby defining a longitudinal axis, and at least two risers extending between the foot and boot rest coupled thereto through pivotal joints. The rear leg brace has an upper leg binding, and an extension coupling the upper leg binding to articulating stilt. According to further manifestations, the rear leg brace may be fixed or pivotal relative to the risers, and when pivotal, may be adjusted to user preferred angular orientations. The use of a rear-mounted brace eliminates undesirable torque during movement, enabling a more anatomically and bio-mechanically correct movement. This bio-mechanically correct movement results in less stress on muscles and joints and in turn allows a user to work more comfortably for extended periods of time.

16 Claims, 1 Drawing Sheet

U.S. PATENT DOCUMENTS

2007/0219070 A1 9/2007 Anderson
2007/0219643 A1 9/2007 Townsend et al.
2007/0232459 A1 10/2007 Lin
2007/0270288 A1 11/2007 Hansard
2008/0058171 A1 3/2008 Sener et al.
2008/0096732 A1 4/2008 Lin et al.

REAR BRACE ARTICULATING STILT

CROSS REFERENCE TO RELATED APPLICATIONS

This application claims priority to U.S. provisional patent application 60/933,575 filed Jun. 7, 2007 naming the present inventor and incorporated herein by reference in entirety.

BACKGROUND OF THE INVENTION

1. Field of the Invention

This application pertains generally to elevated walking devices involving user translation, commonly referred to as stilts, and more particularly to articulating stilts having a rear leg brace. The present invention provides a natural bio-mechanical motion that has been unattainable in the prior art.

2. Description of the Related Art

The concept of stilts is a very old one, predating the United States patent system. Illustrating this is U.S. Pat. No. 31,210 to Johnson, simply entitled "Stilt," dating back to January, 1861. This patent is clearly not the first conception of stilts, but is instead an improvement thereto. At the time of this patent, this stilt simply provided a foot rest or step onto which a user would stand, without any straps or bindings holding one's shoes thereto, and with hand-held braces extending up the outside of each stilt.

As might be expected from such an old technology, there have over the years been a wide variety of improvements, and an associated increase in applications to which the benefits of stilts have been applied. One application from earlier times is believed to have been simply that of improved transportation, through both wetlands and also above troublesome low-lying flora and fauna. Through the years, and beyond entertainment with which most people are familiar, many other diverse applications have evolved. There are many agricultural applications, including the gathering of fruits and nuts, the pruning of trees, and improved viewing of flocks. Construction applications have likewise developed, including the use of stilts with drywall finishing, painting, electrical and plumbing work, window washing, and ceiling installation and repair. There have been many other diverse applications too numerous to mention where the additional elevation afforded by stilts has or might prove to be highly desirable.

One patent which is particularly exemplary of the improvements that have been made to stilts is U.S. Pat. No. 3,902,199 to Emmert, the teachings which are incorporated by reference. The Emmert patent illustrates one particular stilt design which has met with much long term commercial success. Therein, an articulating stilt is illustrated. For the purposes of the present specification, an articulating stilt will be understood to mean a stilt which permits a variation in the angle between a line drawn between the toe and heel of the stilt and the vertical risers, and which couples this variation in angle to a boot engaging member or members, such that the wearer will have an ability to both sense and through natural movement control the variation of this aforementioned angle. Through the linkages illustrated and taught by Emmert, a wearer has the ability to pivot their foot and the stilt foot in a natural motion during forward and backward movement. It is, for example, possible to remove all weight from the heel portion, and stand entirely on the toe portion of the stilt. This articulating motion allows substantially greater control and balance than achieved with other stilt designs.

The Emmert stilt provides much more sensory feedback and control than those of the prior art, and as a result has become a standard in the industry today. Others have attempted to improve upon this concept, using such techniques as the combination of a prosthetic foot with a leg support apparatus, or various spring feet or the like. Instead, the industry has continued with the articulated stilt, owing to the better sense and natural movement. A large number of patents are representative of this adoption, including U.S. Pat. Nos. 4,570,926 and 5,498,220 to Ensmenger; U.S. Pat. No. 6,517,586 to Lin; U.S. Pat. No. 6,648,803 to Jay; published application 2002/0077704 to Lin; published application 2003/0203793 to Emmert; published application 2005/0202940 to Simmons; published applications 2006/0217241 and 2007/0027004 to Novara; published application 20070167296 to Hika; and U.S. Pat. No. D359,313 to Hashman; the teachings of each which are incorporated herein by reference.

The present inventor has discovered a deficit in the prior art articulated stilts. Each of these prior art stilts uses either a single side-mounted leg brace, or a pair of opposed side-mount braces for each stilt. When a single side-mounted leg brace is used on a stilt, the brace extends adjacent the outer part of the wearer's leg, distal to a leg brace on the other stilt. In other words, a stilt for the left leg will have a leg brace extending to the left of the wearer's leg, while a stilt for the right leg will have a right leg brace extending to the right of the wearer's leg. This placement of leg braces has been the standard at least since the time of the Johnson U.S. Pat. No. 31,210 referenced herein above, from January, 1861.

The present inventor has discovered that side placement of the brace produces very undesirable torque upon the leg of a user during ordinary movement. As a wearer steps forward with one leg, the leg brace will at different times in the motion engage and apply force upon the user's lower leg. This force is not in line with the forward leg movement, and so will produce a distinct twisting or torque upon the user's leg. That torque is one of the factors that requires compensation by the user, in the form of muscle movement that is not otherwise a part of ordinary walking or striding. Without muscular compensation, the stilts will undesirably move in a direction out of in-line with the stride, and will also tend to rotate or wobble undesirably, either of which may also produce a very undesirable tumble.

The two opposed side-mount braces avoid this deficiency. However, where the articulated stilt uses two opposed side-mount braces per stilt, the wearer has two braces running between his legs, and as he steps forward or backward, these braces are easily conflicting. It may be apparent that, should these inner braces from different stilts collide, the user may inadvertently and undesirably fall. In addition, the use of two braces increases the parts required, and undesirably increases the weight and cost of the stilt.

A few artisans have attempted other placement of the leg brace, on non-articulating stilts. Exemplary of these are U.S. Pat. No. 642,841 by Freshour; U.S. Pat. No. 2,827,897 by Pawlowski; U.S. Pat. Nos. 5,295,932 and 5,514,054 to Rowan; U.S. Pat. No. 6,719,671 by Bock; and U.S. Pat. No. 6,840,893 by Yoon; the teachings of each which are incorporated herein by reference. These non-articulating stilts do not offer the sensory feedback or natural movement and control afforded by articulating stilts, and so have not been well accepted in the marketplace.

A number of other types of stilts are known and represented in the prior art. Exemplary patents include U.S. Pat. No. 4,255,822 to Dixon; U.S. Pat. No. 4,415,063 to Hutchinson; U.S. Pat. No. 5,016,869 by Dick et al; U.S. Pat. No. 5,593,373 to Hale; and French patent 2,620,345 to Champel; the teachings of each which are incorporated herein by reference.

In spite of the capabilities that are afforded through these stilts or leg extensions, an important issue has always been and continues to be that of safe use. As is well known, the additional height that the stilts provide is the feature that makes stilts desirable in many applications, but is also the feature that makes falls far more dangerous. Falls from only somewhat greater heights are disproportionately more hazardous. In addition, the extra length provided by the stilts in association with the coupling between person and stilts at only a few discrete places may also place unusual forces upon the leg that can lead to strains, sprains and fractures that are both different from and frequently more severe than could occur without the stilts. Finally, a wearer has no sensitivity at the extremity, which is quite unlike a living foot containing many active sensory nerves. Consequently, electrical cords, ropes, wires, uneven surfaces, and other obstacles and challenges may adversely affect the ability of a person to step properly and might then lead to a spill. In view of the direct correlation of harm with a fall where a person was wearing stilts, the chances of problems have heretofore been believed to be greater with stilts than without. As a result, the use of stilts has been effectively eliminated in the workplace in several states.

The banning of stilts in the workplace is surprising when the alternatives to stilts are considered. For exemplary purposes, in the construction trade the use of a ladder is extremely inefficient. A worker may only reach a few feet in each direction from the ladder without unbalancing the ladder and potentially tipping it. On uneven or irregular surfaces, the ladder may even initially be unbalanced, not standing correctly on all four feet. A worker trying to reach too far in any direction while on a ladder, including but not limited to climbing to the top of a ladder, is known to be the cause for many construction injuries. To expand reach and elevation, while still avoiding the use of stilts, other workers rely instead upon portable scaffolding. This scaffolding requires significant set-up and take-down time, and the scaffolding itself may have significant mass or weight. The disassembly and movement of such scaffolding is, in and of itself, a common cause of workplace injuries. The need for more natural and more readily controlled stilts is therefore well established in the industry, and the present stilts do not fully address the need.

What is desired then is a way to best ameliorate the deficiencies of prior art stilts, such that the risks of use are less than the risks associated with alternatives, so that the use of stilts may be applied to all situations where stilts are inherently more efficient than the alternatives.

SUMMARY OF THE INVENTION

The present invention combines an articulated stilt with a curved, rear-mounted leg support or brace behind the leg of the user. The use of a rear-mounted brace eliminates undesirable torque during movement, thereby also eliminating awkward and unnatural muscle movement associated with prior art stilts. The resulting combination of the present invention is more natural, reducing the likelihood of false or unintentional movements that may lead to harm.

In a first manifestation, the invention is, in combination, an articulating stilt and a rear leg brace. The articulating stilt has a foot operative to contact a surface to be traversed, a boot rest operative to support a human foot thereon extending in a longitudinal direction between a heel region and toe region and thereby defining a longitudinal axis, and at least two risers extending between the foot and boot rest coupled thereto through pivotal joints. The rear leg brace has an upper leg binding, and an extension coupling the upper leg binding to articulating stilt. The extension is displaced from the toe region farther in a direction parallel to said longitudinal axis than said heel region is displaced from said toe region. According to further manifestations, the rear leg brace may be fixed or pivotal relative to the risers, and when pivotal, may be adjusted to user preferred angular orientations.

OBJECTS OF THE INVENTION

A first object of the invention is to provide a relatively safer stilt than has heretofore been available. A second object of the invention is to increase the sensitivity, control, and stability that a user has when using stilts designed in accord with the present invention. An ancillary object is the provision of a stilt which affords correct bio-mechanical movement. Another object of the present invention is an improvement in the comfort of stilts, accompanied by a reduced amount of fatigue, such that the stilts may be worn for long periods of time to meet the requirements of certain applications.

BRIEF DESCRIPTION OF THE DRAWINGS

The foregoing and other objects, advantages, and novel features of the present invention can be understood and appreciated by reference to the following detailed description of the invention, taken in conjunction with the accompanying drawing, in which.

DESCRIPTION OF THE PREFERRED EMBODIMENT

Figure 1:
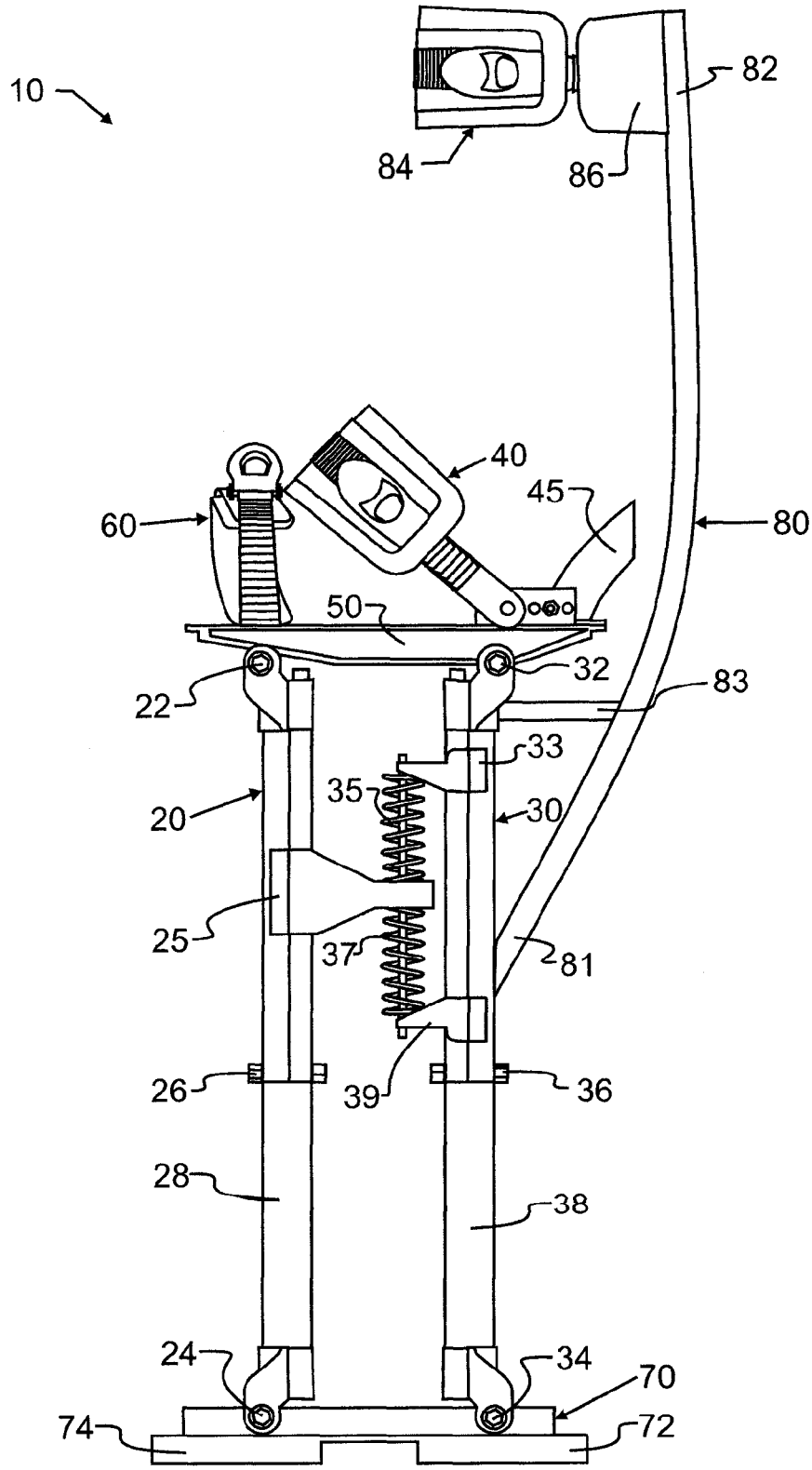
FIG. 1 illustrates a preferred embodiment rear brace articulating stilt designed in accord with the teachings of the present invention from a side plan view.

Manifested in the preferred embodiment, the present invention provides a relatively safer and more easily worn stilt than has heretofore been available. This is achieved through the positioning of a leg brace at the rear of the stilt.

A preferred embodiment articulating stilt 10 incorporating a rear brace 80 is illustrated in FIG. 1. Articulating stilt 10 most preferably incorporates the articulation as illustrated by Emmert and incorporated herein above by reference. Stilt 10 has a foot 70 operative to contact a surface to be traversed, which would ordinarily be the ground, a floor or other surface. While not essential to the present invention, a heal pad or surface 72 may be provided, and a toe pad 74. A boot rest 50 is designed to support a human foot, boot, foot covering or the like thereon. Boot rest 50 will preferably include bindings 40, 60 to securely hold a foot, boot, foot covering or the like in secure position relative to boot rest 50. More detailed description of bindings 40, 60 and the balance of boot rest 50 may be found in my co-pending patent application Ser. No. 11/613,115 filed Dec. 19, 2006, the entire contents which are incorporated herein by reference.

At least two risers 20, 30 extend between foot 70 and boot rest 50. Riser 20 is coupled through a pivot 22 to boot rest 50, and through pivot 24 to foot 70. Similarly, riser 30 is coupled through a pivot 32 to boot rest 50, and through pivot 34 to foot 70. These pivots provide the important articulation which permits natural balance and movement. As may be recognized from the illustration in FIG. 1, this combination of risers 20, 30, with boot rest 50 and foot 70 form a quadrilateral linkage which in the preferred embodiment is also a parallelogram.

Risers 20 and 30 in the preferred embodiment are adjustable in length, by passing pins, bolts, or other suitable fasteners 26, 36 through one of an assortment of holes in lower riser members 28, 38. Most preferably, such a plurality of holes will be generally vertically displaced from each other. The length of these risers 20, 30 in turn determines the elevation provided by stilts 10. In typical construction applications this may only be one or a few feet, though in other applications very different riser lengths may be appropriate.

While not essential to the invention, a centering spring arrangement is provided which comprises a pair of brackets 33, 39 anchored to riser 30, and having a pair of springs 35, 37 extending therebetween. At the juncture between springs 35, 37 is a bracket 25, which is anchored to riser 20. A rod may be provided which passes through the center of springs 35, 37, ensuring that the springs are captured and not able to be dislodged from proper position. In operation, when stilt 10 is tilted forward or backward, bracket 25 will move relative to brackets 33, 39, alternatively compressing one or the other of springs 35, 37. When no force at all is applied, such as when stilt 10 is lifted from the ground, springs 35, 37 in cooperation with bracket 25 will ensure that stilt 10 returns to a neutral position as illustrated in FIG. 1.

An upper leg strap 84 and a rear brace 80 coupling boot rest 50 to upper leg strap 84 are also provided. Rear brace 80 extends from riser 30 through a gentle arc or curve upwards to the rear side of the leg of a wearer. In the preferred embodiment rear brace 30 is in a plane parallel to the paper which is also co-planar with risers 20, 30. This alignment ensures that no rotational torque will be generated during striding or walking movement.

Preferably, upper leg strap 84 is adjustably coupled with rear brace 80 adjacent to upper termination 82, such that upper leg strap 84 may be raised or lowered along rear brace 80 to accommodate different wearers' preferences. Such adjustment may be made through any suitable means, including but not limited to a plurality of fastener holes in rear brace 80 within which a complimentary fastener may pass to couple upper leg strap 84 to rear brace 80.

It is highly preferred that riser 30 and pivot 32 align as closely as possible with upper leg strap 84. This preference is due to the desire to limit any distance change between the point where upper leg strap 84 couples to a wearer and boot rest 50. Said another way, if a person were to pivot their ankle to lower their toes, their foot between toes and heel lowers. If pivot 32 is in line with boot rest 50, then there is no distance change required between upper leg strap 84 and boot rest 50. Consequently, a user may securely strap upper leg strap 84, and not experience any relative motion. For purposes of contrast with the present invention, if pivot 32 were offset to the right in FIG. 1 and therefore adjacent to heel cup 45, then the person's foot would need to lower above riser 30. Such motion would require movement between the wearer's leg and upper leg strap 84, which is not possible if upper leg strap 84 is securely fastened.

In the preferred embodiment, rear brace 80 is coupled directly to riser 30 adjacent to rear brace termination 81. This coupling in the preferred embodiment is a rigid, welded connection, though other suitable coupling may be used. Additional strength may be gained by providing a securing member 83. In one conceived alternative embodiment, the coupling between rear brace 80 and riser 30 is pivotal. In this alternative embodiment, securing member 83 is extensible, through any suitable means including but not limited to the fastener and hole arrangement similar to that used on each riser 20, 30, to vary the angular relationship between riser 30 and rear brace termination 81. This varied angular relationship permits rear brace 80 to be tilted farther rearward or forward, to further accommodate a user's preference.

It will be appreciated from the foregoing description that coupling rear brace 80 directly and rigidly to boot rest 50 is not desirable, since when the wearer tilts their foot, they do not want upper leg brace 84 to move. However, it is contemplated herein that rear brace termination 81 may alternatively be coupled, for exemplary purposes, to pivot 32. In yet a further alternative, a separate pivotal coupling may be provided to couple rear brace 80 directly to boot rest 50.

Preferably, upper leg strap 84 will most preferably include sufficient padding to adequately distribute forces across a larger surface area than in the prior art without constricting circulation within the leg. An added benefit to the use of quick-release ratcheting straps as illustrated herein arises from the facility and speed by which the preferred embodiment may be attached and detached. With only a few quick movements, the user may step into and tighten the preferred embodiment, and with even fewer and simpler quick movements, the user may disengage and release the preferred embodiment.

With padding appropriate to the particular strap, these preferred quick-release ratcheting straps will also vastly improve the comfort of the stilts, accompanied by a reduced amount of fatigue. Not only do the straps reduce fatigue, but the rear brace likewise generates less fatigue. This is because, without undesirable torque, the user does not have to use unusual muscles to keep their feet properly aligned as they walk about. In turn, reduced fatigue means that the stilts of the preferred embodiment may be worn for long periods of time to meet the requirements of certain applications. This not only improves work efficiency, but it is also known that fatigue is a common cause of many mishaps. It follows then that reducing the amount of fatigue, so long as a worker still stops at or near the same time, will also reduce the likelihood for mishaps or injuries.

Heel binding 45 includes an arched heel cup which defines a rear limit to movement of a human foot, shoe or boot upon boot rest 50 as disclosed in my co-pending patent application Ser. No. 11/613,115 incorporated herein above by reference. As is visible in FIG. 1, this arched heel cup rises above boot rest 50 substantially, which permits the lower heel portion of a foot covering or foot to be captured between the arched heel cup and boot rest 50. The geometry of the arched heel cup may be customized, where desired to conform to one or more particular types of foot coverings, to best engage therewith. For exemplary purposes only, and not limited thereto, some boots have a pronounced Achilles tendon region which is recessed relative to the sole adjacent to the heel. In such instance, the arched heel cup may be shaped to define an arch which matches the geometry of the particular shoe, or of shoes or boots of more broad types or geometries. As may be apparent, the angle of binding 40 leads to the drawing of a human foot or foot covering against boot rest 50 and the heel cup when binding 40 is tightened, for securement therewith. This ensures that the user's foot will remain properly aligned with riser 30, pivot 32 and upper leg strap 84.

The present invention, as manifested by the present preferred embodiment, provides a stilt which affords correct bio-mechanical movement. This is because the user may extend the stilt in front of their leg, as with a normal walking motion. In the prior art, using the known heel cups and straps, the wearer's heel would be prone to slipping or total release from the heel cup. This would, in turn, lead to a spill and possible injury, since the stilt would fail to stay properly aligned and coupled to the person's leg. In contrast, in the present invention such motions are desirable. With the preferred articulating stilt, as described and taught herein, even the articulation within the ankle joint is preserved. No torque is generated by ordinary striding or walking. Consequently, bio-mechanical movements which mimic ordinary movements are preserved.

From the foregoing descriptions, it should now be apparent that the materials used for the production of the present invention and embodiments thereof is not critical, so long as the materials do not interfere with the functions and operations that have been outlined herein above. As but one example, the preferred embodiment may be fabricated from metals suitable for the intended work environment. However, a number of plastics and composites are known which would provide suitable performance. Consequently, one of ordinary skill in the art, with the knowledge of the present disclosure, will choose materials suitable for a given application in consideration of an intended ultimate cost of fabrication.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, an articulating stilt and a rear leg brace, said articulating stilt comprising:

a foot operative to contact a surface to be traversed;

a boot rest operative to support a human foot thereon extending in a longitudinal direction between a heel region and toe region and thereby defining a longitudinal axis; and at least two risers extending between said foot and said boot rest and coupled thereto through pivotal joints;

said rear leg brace comprising:

an upper leg binding;

an extension coupling said upper leg binding to said articulating stilt, said extension displaced from said toe region farther in a direction parallel to said longitudinal axis than said heel region is displaced from said toe region wherein said at least two risers are generally parallel and form a quadrilateral linkage with said boot rest and said foot.

2. The combination articulating stilt and rear leg brace of claim 1, wherein said quadrilateral linkage further comprises a parallelogram.

3. The combination articulating stilt and rear leg brace of claim 1, wherein said at least two risers further extend between and space said foot and said boot rest.

4. The combination articulating stilt and rear leg brace of claim 1, wherein said at least two risers and said extension are generally co-planar.

5. The combination articulating stilt and rear leg brace of claim 1, wherein said extension couples to a first one of said at least two risers.

6. The combination articulating stilt and rear leg brace of claim 5, wherein said extension couples to a first one of said at least two risers through a rigid connection.

7. The combination articulating stilt and rear leg brace of claim 5, wherein said extension couples to a first one of said at least two risers through a pivotal connection.

8. The combination articulating stilt and rear leg brace of claim 7, further comprising a securing member having a user adjusted length securing said extension to said first one of said at least two risers at an angle varied by said user adjusting said securing member length.

9. An articulating stilt having a rear brace, comprising:

a stilt foot operative to engage with a surface to be traversed;

a boot rest operative to support a human foot thereon extending in a longitudinal direction between a heel region and toe region and thereby defining a longitudinal axis;

at least two generally parallel risers extending between said foot and said boot rest and coupled thereto through pivotal joints to thereby form a quadrilateral linkage;

an upper leg binding operative to receive a human leg and securing thereto;

an extension coupling said quadrilateral linkage to said upper leg binding, said extension displaced from said toe region farther in a direction parallel to said longitudinal axis than said heel region is displaced from said toe region.

10. The articulating stilt of claim 9, wherein said quadrilateral linkage further comprises a parallelogram.

11. The combination articulating stilt and rear leg brace of claim 9, wherein said at least two risers and said extension are generally co-planar.

12. The combination articulating stilt and rear leg brace of claim 9, wherein said extension couples to a first one of said at least two risers.

13. The combination articulating stilt and rear leg brace of claim 12, wherein said extension couples to a first one of said at least two risers through a rigid connection.

14. The combination articulating stilt and rear leg brace of claim 12, wherein said extension couples to a first one of said at least two risers through a pivotal connection.

15. The combination articulating stilt and rear leg brace of claim 14, further comprising a securing member having a user adjusted length securing said extension to said first one of said at least two risers at an angle varied by said user adjusting said securing member length.

16. In combination, an articulating stilt and a rear leg brace, said articulating stilt comprising:

a foot operative to contact a surface to be traversed;

a boot rest operative to support a human foot thereon extending in a longitudinal direction between a heel region and toe region and thereby defining a longitudinal axis; and at least two risers extending between said foot and said boot rest and coupled thereto through pivotal joints;

said rear leg brace comprising:

an upper leg binding;

an extension coupling said upper leg binding to said articulating stilt, said extension displaced from said toe region farther in a direction parallel to said longitudinal axis than said heel region is displaced from said toe region, wherein said extension couples to a first one of said at least two risers through a pivotal connection;

said articulating stilt further comprising a securing member having a user adjusted length securing said extension to said first one of said at least two risers at an angle varied by said user adjusting said securing member length.

* * * * *